US006837765B2

(12) United States Patent
Lauzière

(10) Patent No.: US 6,837,765 B2
(45) Date of Patent: Jan. 4, 2005

(54) FLOTATION DEVICE

(76) Inventor: Michel Lauzière, 263, Chemin Mont Ste-Anne, Ste-Anne des Lacs, Québec (CA), J0R 1B0

( * ) Notice: Subject to any disclaimer, the term of this patent is extended or adjusted under 35 U.S.C. 154(b) by 0 days.

(21) Appl. No.: 10/620,574

(22) Filed: Jul. 17, 2003

(65) Prior Publication Data

US 2004/0023572 A1 Feb. 5, 2004

(30) Foreign Application Priority Data

Jul. 17, 2002 (GB) ..... 0216559

(51) Int. Cl.[7] ..... B63C 9/28
(52) U.S. Cl. ..... 441/130; 441/132; 472/129
(58) Field of Search ..... 441/40–42, 88, 441/106, 125–132; 114/345; 482/55; 472/128, 129; 297/467; D12/316; D21/801–809

(56) References Cited

U.S. PATENT DOCUMENTS

| | | | | | |
|---|---|---|---|---|---|
| 802,221 | A | * | 10/1905 | Kuhnen et al. | 441/126 |
| 2,245,401 | A | * | 6/1941 | Hooker | 440/104 |
| 2,496,460 | A | * | 2/1950 | Evans | 441/40 |
| 2,688,207 | A | * | 9/1954 | Hurt | 472/129 |
| 3,167,794 | A | * | 2/1965 | Brown | 441/118 |
| 3,860,976 | A | * | 1/1975 | Suyama | 4/575.1 |
| 4,580,988 | A | * | 4/1986 | Correll | 441/130 |
| D287,870 | S | * | 1/1987 | Wolfe | D21/808 |
| 4,768,774 | A | * | 9/1988 | Beasley | 482/111 |
| 5,088,723 | A | * | 2/1992 | Simmons | 472/129 |
| 5,314,395 | A | * | 5/1994 | Ciolino | 482/111 |
| 5,562,514 | A | * | 10/1996 | Rowe | 441/130 |
| 5,599,063 | A | * | 2/1997 | Lister et al. | 297/325 |
| 5,791,958 | A | * | 8/1998 | Yeung | 441/130 |
| 5,897,409 | A | * | 4/1999 | Hartman et al. | 441/129 |
| 6,027,393 | A | * | 2/2000 | O'Rourke | 446/153 |
| D465,823 | S | * | 11/2002 | Lundberg | D21/803 |
| 6,692,322 | B1 | * | 2/2004 | Heatherly | 441/132 |

FOREIGN PATENT DOCUMENTS

DE 3328331 A * 2/1985 ..... B63C/9/04

* cited by examiner

*Primary Examiner*—S. Joseph Morano
*Assistant Examiner*—Ajay Vasudeva

(57) ABSTRACT

A flotation device includes an elongate buoyant body and an outwardly extending seat disposed intermediate first and second longitudinal ends of the buoyant body. The flotation device is configured to buoyantly support a user in both a reclining and a sitting position. In the reclining position, the body is disposed in a substantially flat configuration. In the sitting position, the body is substantially bent adjacent the seat for at least partially supporting the trunk of the user, and the seat extends between the legs of the user for abuttingly supporting the crotch of the user. The seat is provided with an oar coupling assembly for operatively coupling an oar thereto. The buoyant body is further provided with a solidifying component that extends outwardly from the body to act as a keel when the body is in the reclined position.

30 Claims, 4 Drawing Sheets

Fig. 5
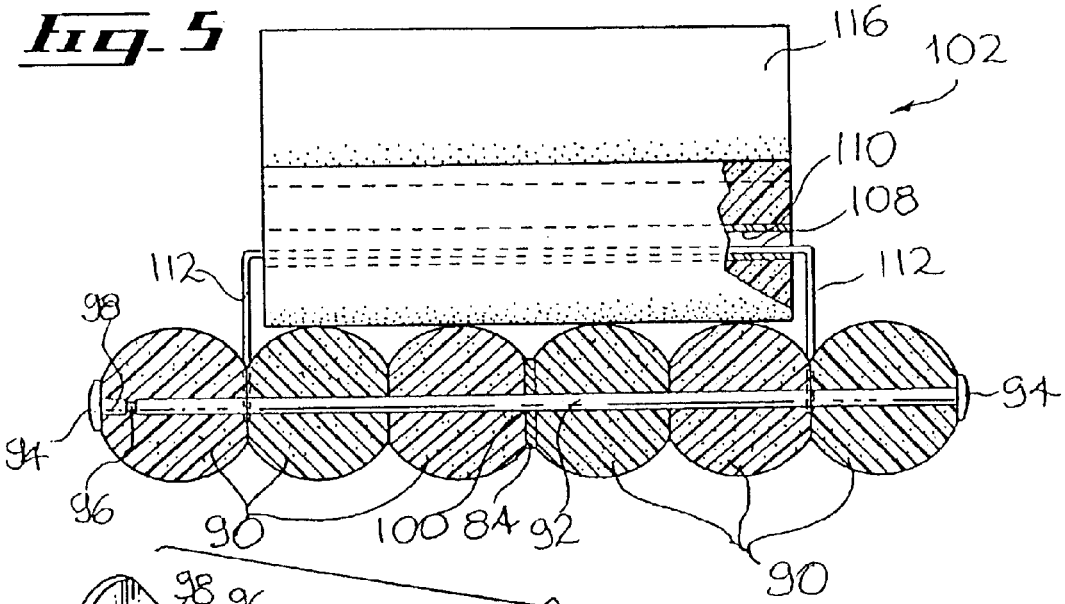
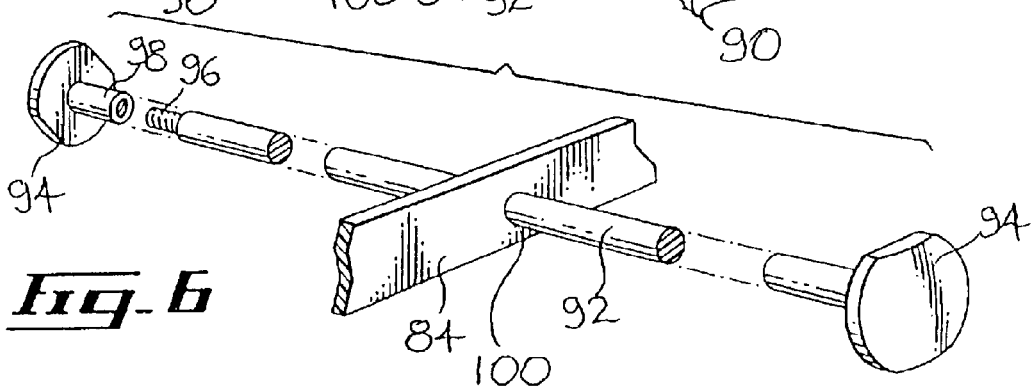
Fig. 6
Fig. 7
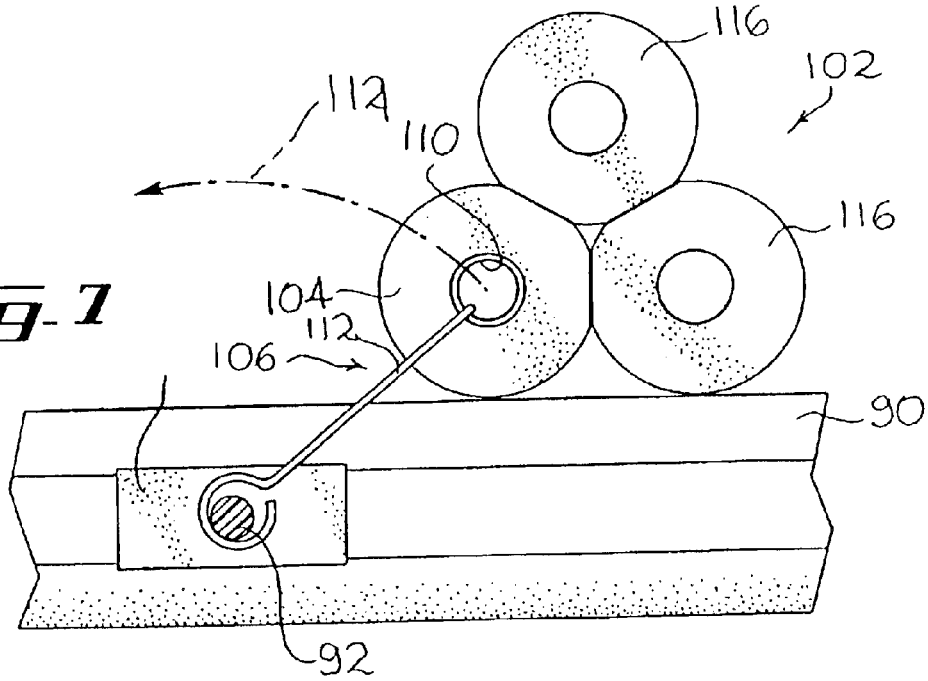

FLOTATION DEVICE

FIELD OF THE INVENTION

The present invention relates to the general field of recreational water devices and is particularly concerned with a flotation device.

BACKGROUND OF THE INVENTION

Floatation devices used for the purpose of recreational floatation or body support of an individual in a body of water such as a pool, have long been popular and are now available in a variety of configurations. Indeed, the use of recreational floatation devices is widespread.

Various types of particularly popular floatation devices include inflatable rafts, floating chairs, inner tubes and large ridged pieces of foam. Although popular, these prior art devices nevertheless suffer from numerous drawbacks.

For instance, one of the most popular type of floatation device includes inflatable mattresses made of a flexible and air impermeable material such as vinyl plastic. These inflatable air mattresses may be simple and inexpensive or elaborate and expensive. Inflatable products are distributed in many shapes such as, for example, whales, dinosaurs, lobsters and the like. These mattresses may be provided, for example, with handle grips, drinking glass holders, leg apertures and clear plastic viewing windows to look through into the water under the inflatable device.

Although enjoyable, these devices suffer from numerous disadvantages including the fact that they must be inflated, such as by using a pump or by the user blowing into a valve. Both procedures may prove to be tedious, time consuming and exhausting.

Furthermore, over inflation or under inflation is always a concern. Once the devices are inflated, pin-hole leaks can develop allowing air to escape causing them to deflate and gradually become less effective in their continued use, at which point the floatation device must be either re-inflated or the hole must be patched. Furthermore, their construction typically involves seams, which may be difficult to repair if a puncture or tear occurs.

Another type of relatively popular floatation device includes a construction using a rigid or semi-rigid foam slab material. These types of devices are typically composed with two large opposing flat surfaces. There may be a foam pillow incorporated at one end for head and neck support. One of the disadvantages associated with this type of product is that lying on the foam slab results in a high center of gravity above the surface of the water. Thus, it is relatively easy to tip about the center axis of the device or to lose balance while moving about on the slab.

Another type of prior art floatation device includes water loungers or water mattresses having stacked layers of air bubble sheet plastic encased in flexible plastic sheet or mesh. This type of device suffers from some of the hereinabove mentioned disadvantages.

Yet another type of prior art device involves adding floatation structures to conventional floatable chairs. These devices have the disadvantage of being bulky and may use metal frames, for example tube frames which may bent or crack. The frames may also rust or decay with use, especially when used in recreational pool water containing traces of chlorine. This type of water lounger also tends to be easy to tip.

Most of these prior art devices also suffer from drawbacks such as their inherent tendency to hold the majority of one's body above the surface of the water which reduces the effect of the water on the body. This allows one's body to become relatively warm. It also greatly reduces the movement of the body from propulsion and/or exercise purposes.

Furthermore, they are often only limited to one type of usage, namely either a usage in a sitting or in a supine position, hence lacking versatility. Still furthermore, they are often deprived of propulsion structures, such as paddles, oars or the like. Accordingly, there exists a need for an improved floatation device.

SUMMARY OF THE INVENTION

It is a general object of the present invention to provide an improved recreational floating device.

In accordance with the present invention, there is provided a flotation device for supporting a person in a volume of water, the volume of water defining a surface of water, the person having a trunk defining a trunk front surface and a trunk rear surface, the person also having a head, a pair of arms and a pair of legs all extending from the trunk, the legs merging into a crotch; the flotation device comprising: a substantially buoyant body, the body having a substantially elongated configuration, the body defining a body longitudinal axis, a body first longitudinal end and a substantially opposed body second longitudinal end, the body also defining a body first main surface and an opposed body second main surface; a seat component extending substantially outwardly from the body first main surface intermediate the body first and second longitudinal ends; the body and the seat component being configured, sized and positioned relative to each other so as to allow the device to buoyantly support the person in the volume of water in both a reclining and a sitting position wherein when in the reclining position, the body is in a substantially flat configuration and, wherein when in the sitting position, the body is substantially bent about a bending location positioned substantially adjacent to the seat component so as to allow at least part of the body first surface located between the body first longitudinal end and the seat component to abuttingly support at least part of the trunk rear surface and so as to also allow the seat component to extend between the legs adjacent the crotch of the person for abuttingly supporting the latter.

Typically, the body is made out of a substantially resiliently bendable material at least adjacent to the bending location. Conveniently, the bending location is located intermediate the seat component and the body second longitudinal end. Typically, the body has a substantially "J"-shaped configuration when used in the sitting position for supporting the person in the volume of water.

Conveniently, the body defines a pair of opposed body lateral edges, the body lateral edges tapering towards each other from a tapering location towards the body second longitudinal end. Typically, the tapering location is located intermediate the body second longitudinal end and the seat component substantially adjacent to the latter. Conveniently, the body lateral edges are configured and sized to allow at least a portion of the legs of the person to be located outside the body lateral edges when the flotation device is in the sitting position.

Typically, the body lateral edges are configured and sized to provide the body with a substantially hydrodynamical profile when the flotation device is in the reclining position.

Conveniently, the seat component has a substantially "J"-shaped configuration including a first seating segment having a substantially arcuate configuration extending from the body first main surface and a second seating segment extending from the first seating segment towards the body first longitudinal end in a substantially parallel and spaced relationship relative to the body first main surface. Typically, the seat component is provided with an oar coupling means for operatively coupling an oar thereto.

Conveniently, the seat component is configured, sized and positioned to allow the arms of the person to reach the oar when the flotation device is in the reclining position. Typically, the oar coupling means includes a coupling component extending from the seat component, the oar coupling component allowing releasable coupling of the oar thereto.

Conveniently, the oar coupling component has a substantially "T"-shaped configuration defining a first attachment segment and a substantially perpendicular second attachment segment, the first attachment segment being provided with a pair of oar attachment apertures extending therethrough and the second attachment segment being provided with a pair of forked tines configured and sized for attachment to the seat component on each side of the latter.

Typically, the body is further provided with a solidifying means for forming a solidified portion of the body, the solidified portion extending from a position located substantially adjacent the seat component towards the body first longitudinal end. Conveniently, the solidifying means includes a solidifying component made out of a substantially rigid material, the solidifying component being at least partially embedded in the body. Typically, the solidifying component has a substantially elongated configuration and extends integrally from the seat component.

Conveniently, the flotation device further comprises a keel extending substantially outwardly from the body second main surface. Typically, the body is further provided with a solidifying means for forming a solidified portion of the body, the solidified portion extending from a position located substantially adjacent the seat component towards the body first longitudinal end; the solidifying means including a solidifying component made out of a substantially rigid material, the solidifying component being at least partially embedded in the body, the solidifying component also extending substantially outwardly from the body second main surface to act as a keel when the body is in the reclined position.

Conveniently, the body is made out of at least two generally elongated body sections, the body also including a section attachment means for attaching the body sections together in a lateral relationship relative to each other. Typically, at least one of the body sections is made out of closed cell foam material. Conveniently, the section attachment means includes an attachment rod extending substantially transversally across the body sections.

Typically, the attachment rod is provided with a releasable rod locking means for releasably locking the rod in a predetermined attachment configuration wherein the attachment rod releasably maintains the body sections in a side-by side relationship relative to each other.

Conveniently, the body is further provided with a solidifying means for forming a solidified portion of the body, the solidified portion extending from a position located substantially adjacent the seat component towards the body first longitudinal end; the solidifying means including a solidifying component made out of a substantially rigid material, the solidifying component being at least partially embedded in the body, the solidifying component being provided with a rod receiving g aperture extending therethrough, the attachment rod extending substantially fittingly through the rod receiving aperture.

Typically, the flotation device further comprises a headrest component, the headrest component being attached to the body so as to contact the body first main surface substantially adjacent to the body first longitudinal end. Conveniently, the headrest component is attached to the body so as to be positionable in at least two headrest configurations along the body first main surface.

Typically, the headrest component includes at least one substantially cylindrical headrest section, the headrest component also including a substantially "U"-shaped attachment bracket, the attachment bracket including a retaining segment extending through the headrest section and a pair of substantially perpendicular attachment segment extending from the retaining segment, the attachment segment being pivotaly attached to the body.

Conveniently, the headrest component includes three headrest sections together forming a substantially triangular cross-sectional configuration, the headrest sections being pivotable about the retaining segment to modify the position of the headrest component on the body.

In accordance with the present invention, there is also provided a flotation device for supporting a person in a volume of water, the volume of water defining a surface of water, the person having a trunk defining a trunk front surface and a trunk rear surface, the person also having a head, a pair of arms and a pair of legs all extending from the trunk, the legs merging into a crotch; the flotation device comprising: a substantially buoyant body, the body having a substantially elongated configuration, the body defining a body longitudinal axis, a body first longitudinal end and a substantially opposed body second longitudinal end, the body also defining a body first main surface and an opposed body second main surface; the body allowing the device to buoyantly support the person in the volume of water in both a reclining and a sitting position wherein when in the reclining position, the body is in a substantially flat configuration and, wherein when in the sitting position, the body is substantially bent about a bending location intermediated the body first and second longitudinal ends so as to allow at least part of the body first surface located between the body first longitudinal end and the seat component to abuttingly support at least part of the trunk rear surface and so as to also allow body adjacent the bending location to extend between the legs adjacent the crotch of the person for abuttingly supporting the latter; the body being further provided with a solidifying means for forming a solidified portion of the body, the solidified portion extending from a position located substantially adjacent the bending location towards the body first longitudinal end; the solidifying means including a solidifying component made out of a substantially rigid material, the solidifying component being at least partially embedded in the body, the solidifying component also extending substantially outwardly from the body second main surface to act as a keel when the body is in the reclined position.

In accordance with the present invention, there is still further provided a flotation device for supporting a person in a volume of water, the volume of water defining a surface of water, the person having a trunk defining a trunk front surface and a trunk rear surface, the person also having a head, a pair of arms and a pair of legs all extending from the trunk, the legs merging into a crotch; the flotation device comprising: a substantially buoyant body, the body having a substantially elongated configuration, the body defining a body longitudinal axis, a body first longitudinal end and a substantially opposed body second longitudinal end, the body also defining a body first main surface and an opposed body second main surface; the body allowing the device to buoyantly support the person in the volume of water in both a reclining and a sitting position wherein when in the reclining position, the body is in a substantially flat configuration and, wherein when in the sitting position, the body is substantially bent about a bending location intermediated the body first and second longitudinal ends so as to allow at least part of the body first surface located between the body first longitudinal end and the seat component to abuttingly support at least part of the trunk rear surface and so as to also allow body adjacent the bending location to extend between the legs adjacent the crotch of the person for abuttingly supporting the latter; the body being further provided with a solidifying means for forming a solidified portion of the body, the solidified portion extending from a position located substantially adjacent the bending location towards the body first longitudinal end; the solidifying means including a solidifying component made out of a substantially rigid material, the solidifying component being at least partially embedded in the body, the body being made out of at least two generally elongated body sections, the body also including a section attachment means for attaching the body sections together in a lateral relationship relative to each other; the section attachment means including an attachment rod extending substantially transversally across the body sections; the solidifying component being provided with a rod receiving aperture extending therethrough, the attachment rod extending substantially fittingly through the rod receiving aperture.

Conveniently, the solidifying component also extends substantially outwardly from the body second main surface to act as a keel when the body is in the reclined position.

Advantages of the present invention include that the proposed floatation device forms a buoyant structure which provides the user with a wide range of body positions from sitting upright to supine. Furthermore, it allows an intended user to vary body positions through ergonomical movements while remaining on the device.

Also, the proposed device allows virtually unrestricted use of a user's upper and lower limbs for propulsion and exercise purposes. It also allows accommodation of a wide variety of body shapes and sizes.

Regardless of the body shape or size, it may provide good stability and relatively comfortable fit. It is also relatively easy to get into and out of.

The floatation device in accordance with the present invention may also be easily stored in a relatively confined area yet be ready for use without the need for filling the device with air or other lengthy preparation. Still furthermore, the proposed device optionally provides for removable oars that can be used for propulsion and removed from the device when not in use.

Furthermore, the proposed device may be provided with a reinforcement component for reinforcing a predetermined portion thereof. The reinforcement component may also be configured to further act as a keel and as a means for securing thereto structural components.

The proposed device is manufactured so as to be relatively light weight, yet sturdy. It is designed so as to be manufacturable using conventional forms of manufacturing so as to provide a device that will be economically feasible, long lasting and relatively trouble free in operation. Also, the device is inherently buoyant due to the use of cylindrical tubes of closed cell foam. The device can be readily built using commercially available material such as ETHAFOAM or similar closed cell cylindrical foam floatation material including products sold under the trademark "WATER NOODLE".

BRIEF DESCRIPTION OF THE DRAWINGS

FIG. 5: in a transversal cross-sectional view taken along arrows 5-5 of FIG. 3 illustrates some of the features of the flotation device shown in FIGS. 1, 3, and 4;

FIG. 6: in a partial perspective view with sections taken out illustrates part of a section attachment assembly usable with a flotation device such as shown in FIGS. 1 through 5;

FIG. 7: in a partial side elevational view with sections taken out illustrates a headrest component part of a flotation device in accordance with the present invention;

DETAILED DESCRIPTION

Figures 8, 9, 10, 11:
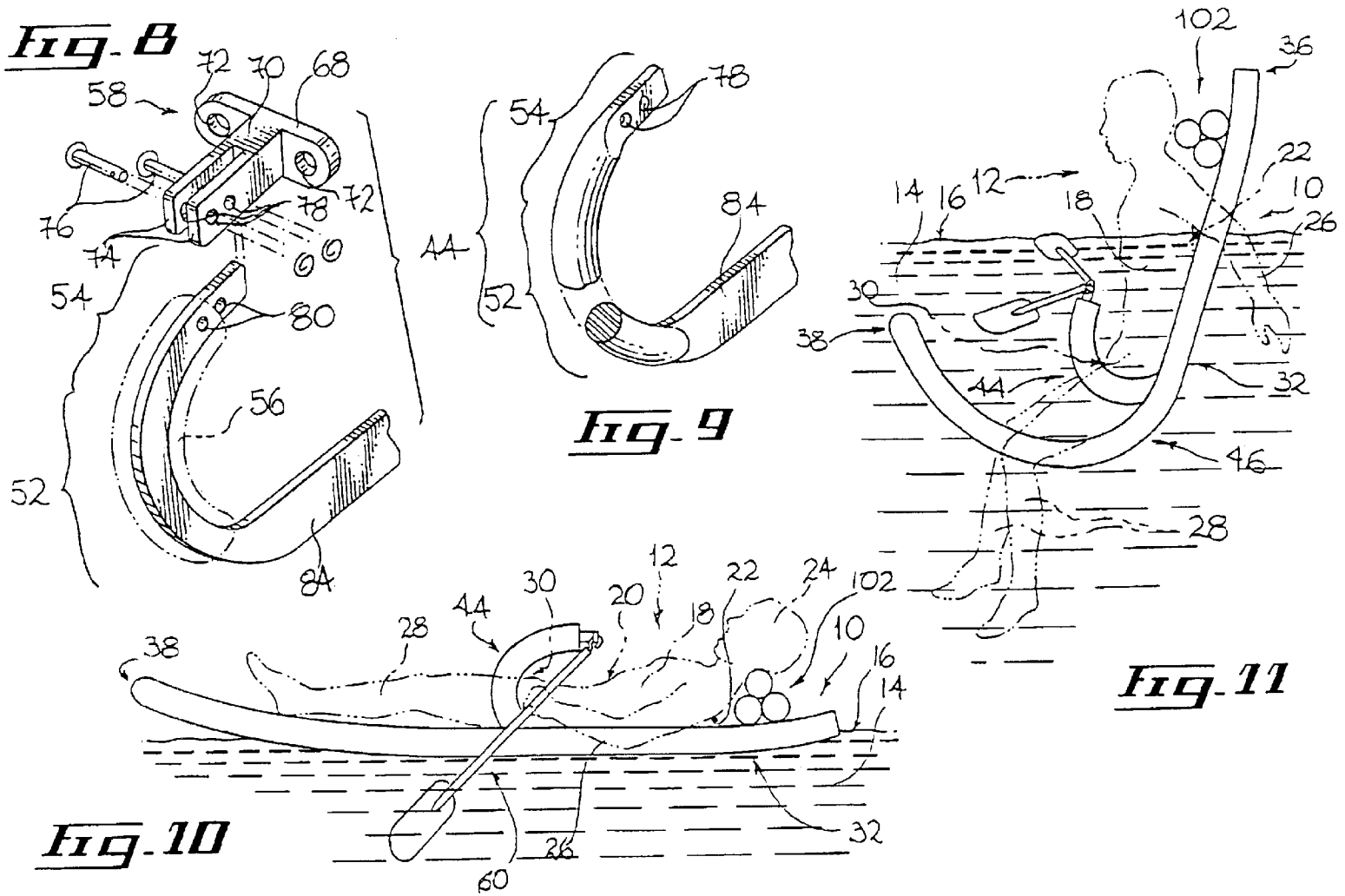
FIG. 8: in a partial exploded view illustrates part of a seat component usable with a flotation device in accordance with the present invention.
FIG. 9: in a partial perspective view with sections taken out illustrates an alternative embodiment of the seat component shown in FIG. 8.
FIG. 10: in a side elevational view illustrates a flotation device in accordance with an embodiment of the present invention in a reclining configuration, the floating device being shown with a person lying thereon, the person being shown in phantom lines.
FIG. 11: in a side elevational view illustrates a flotation device in accordance with an embodiment of the present invention, the flotation device being shown in a seating configuration, the flotation device being shown with a person sitting thereon, the person being shown in phantom lines.

Referring to FIGS. 10 and 11, there is shown a flotation device 10 in accordance with an embodiment of the present invention. The device 10 is typically used for supporting a person 12 in a volume of water 14. The volume of water 14 defines a surface of water 16. It should be understood that although the person 12 is shown as being in a specific positional relationship relative to the surface of water 16, the device 10 could be used in other contexts wherein the intended user 12 may be in other positional relationships relative to the surface of water 16 without departing from the scope of the present invention.

The person 12 is shown schematically as having a trunk 18 defining a trunk front surface 20 and a trunk rear surface 22. The person 12 is also schematically shown having a head 24, a pair of arms 26 (only one of which is shown in FIGS. 10 and 11) and a pair of legs 28 (only one of which is shown in FIGS. 10 and 11) all of which extend from the trunk 18. The legs 28 merge into a crotch region 30.

Figure 1:
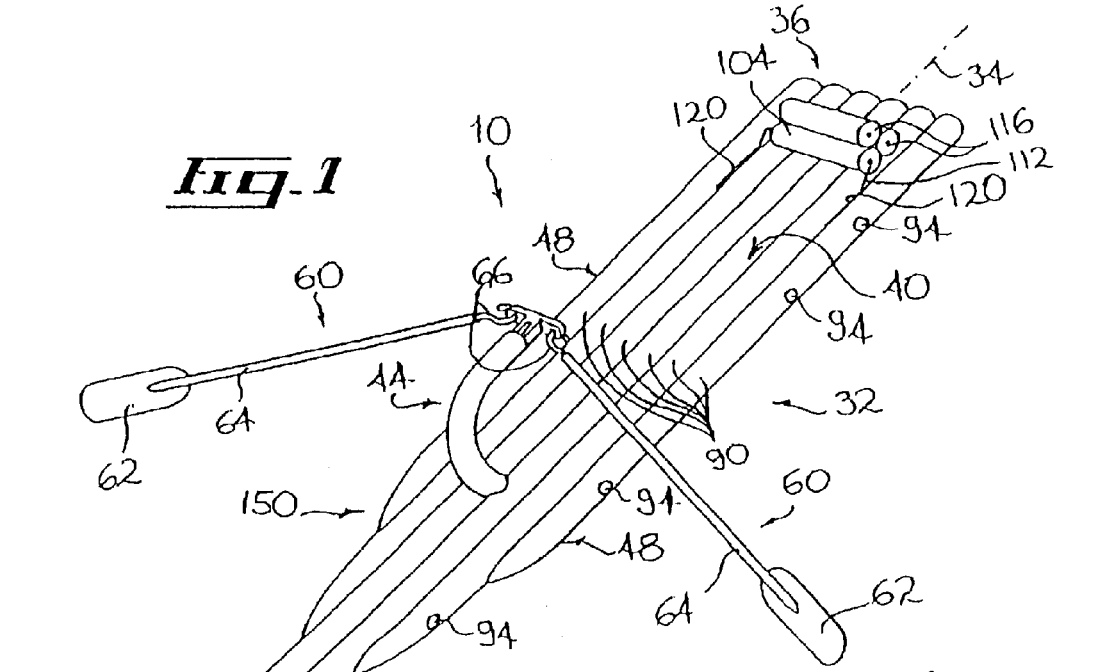
FIG. 1: in a perspective view illustrates a flotation device in accordance with an embodiment of the present invention.
Figure 2:
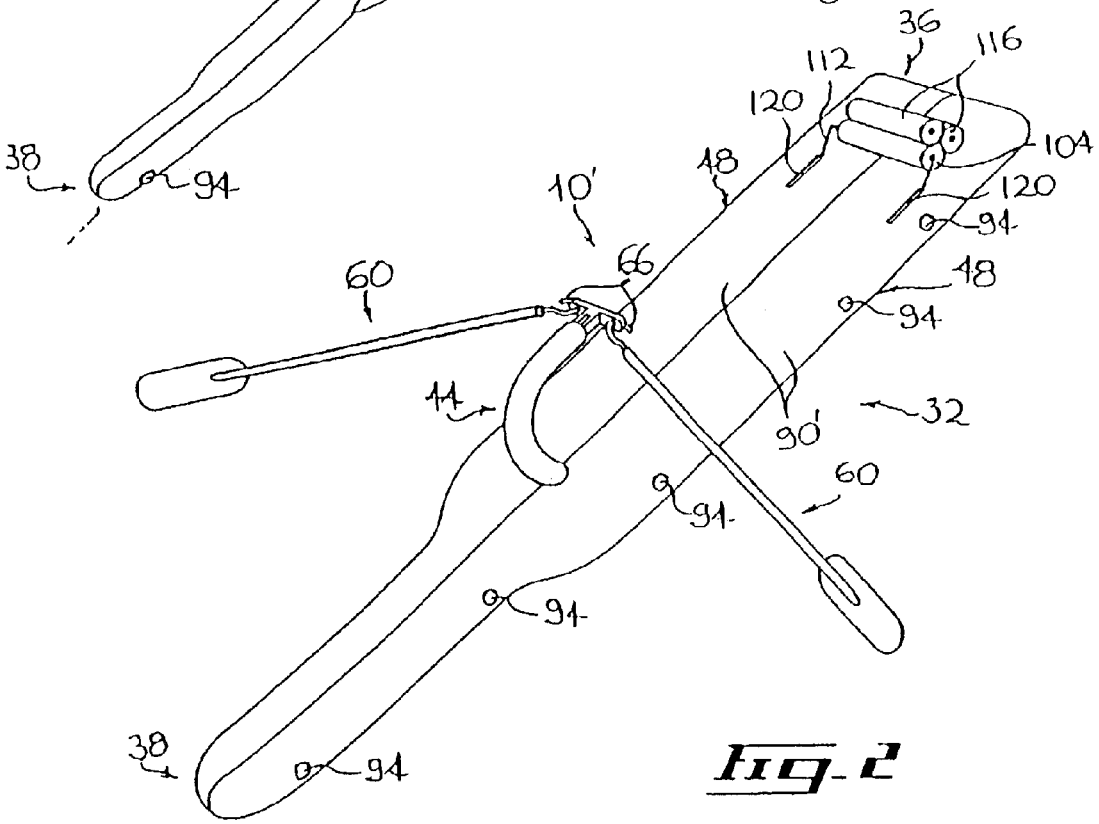
FIG. 2: in a perspective view illustrates a flotation device in accordance with an alternative embodiment of the invention.

As illustrated more specifically in FIGS. 1 and 2, the flotation device 10 includes a substantially buoyant body 32. The body 32 has a substantially elongated configuration when in its reclined position illustrated in FIGS. 1 through 4 and 10. The body 32 defines a body longitudinal axis 34. The body 32 also defines a body first longitudinal end 36 and a substantially opposed body second longitudinal end 38.

Figure 4:
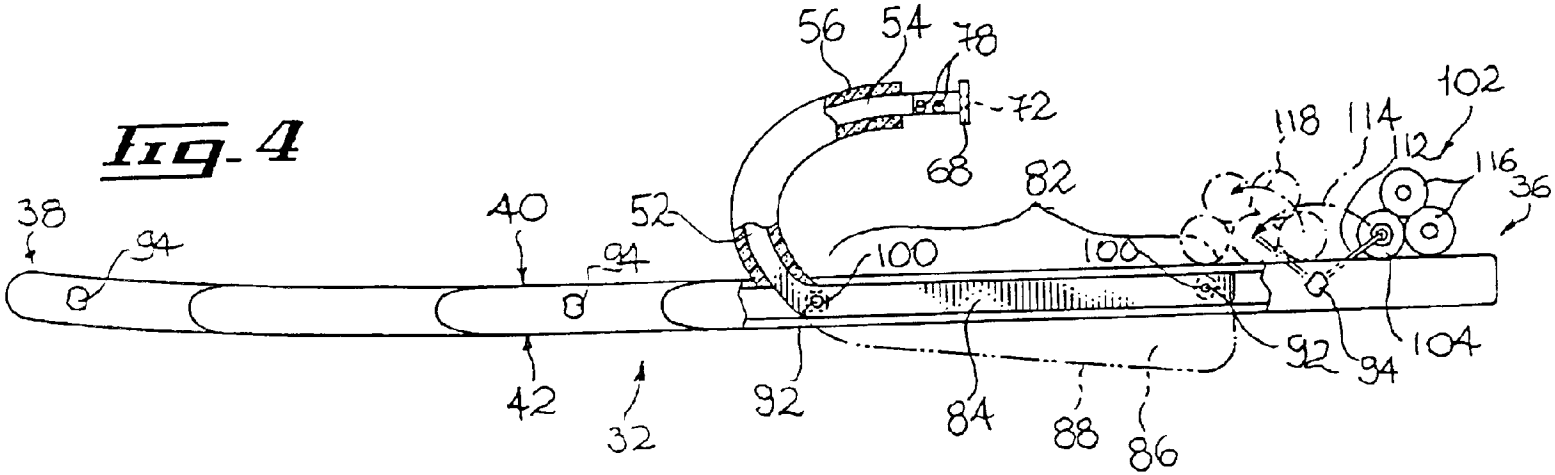
FIG. 4: in a side elevational view with sections taken out illustrates part of the flotation device shown in FIGS. 1 and 3.

The body 32 further defines a body first main surface 40 and an opposed body second main surface 42 (indicated in FIG. 4).

The device 10 also includes a seat component 44 extending substantially outwardly from the body main surface 40 intermediate to the body first and second longitudinal ends 36, 38.

As illustrated in FIGS. 10 and 11, the body 32 and the seat component 44 are configured, sized and positioned relative to each other so as to allow the device 10 to buoyantly support the person 12 in the volume of water 14 in both a reclining position and a sitting position shown respectively in FIGS. 10 and 11. When in the reclining position shown in FIG. 10, the body 32 has a substantially flat configuration. When in the sitting position shown in FIG. 11, the body 32 is substantially bent about a bending location 46 positioned substantially adjacent to the seat component 44.

When the body 32 is bent about the bending location 46, at least part of the body first surface 40 located between the body first longitudinal end 36 and the seat component 44 is allowed to abuttingly support at least part of the trunk rear surface 22 and the seat component 44 is allowed to extend between the legs 28 adjacent to the crotch 30 of the person 12 for abuttingly supporting the latter.

Typically, the bending location 46 is located intermediate the seat component 44 and the body second longitudinal end 38. Also, the body 32 typically has a substantially "J"-shaped configuration when used in the sitting position shown in FIG. 11 for supporting the person 12.

Typically, the body 32 is made out of a substantially resiliently bendable and buoyant material such as closed cell foam. For example, the body 32 may be made out of ETHAFOAM, STYROFOAM (both trademarks) or other suitable material. It should be understood that only part of the body 32, for example a section located adjacent to the bending location 46, may be made out of bendable material without departing from the scope of the present invention.

The body 32 typically further defines a pair of opposed body lateral edges 48. In the embodiments shown throughout the Figures, the body lateral edges 48 taper towards each other from a tapering location 50 towards the body second longitudinal end 38. Typically, the tapering location 50 is located intermediate to the body longitudinal end 38 and the seat component 44 substantially adjacent to the latter.

Typically, the body lateral edges 44 are configured and sized to provide the body 32 with a substantially hydrodynamical profile when the flotation device 10 is in the reclining position. Also, as illustrated more specifically in FIG. 11, the body lateral edges 44 are typically configured and sized to allow at least a portion of the legs 28 to be located laterally outside from the body lateral edges 44 when the flotation device 10 is in the sitting position.

Throughout the drawings, the body 32 is shown as defining a substantially pointed bow and a substantially flat stern. It should, however, be understood that the body 32 could assume other configurations without departing from the scope of the present invention.

As illustrated more specifically in FIGS. 8 and 9, the seat component 44 typically has a substantially "J"-shaped configuration. The seat component 44 hence typically defines a first seating segment 52 having a substantially arcuate configuration extending from the body first main surface 40 and a second seating segment 54 extending from the first seating segment 52 towards the body first longitudinal end 36. The second seating segment 54 typically extends in a substantially parallel and spaced relationship relative to the body first main surface 40 when the body 32 is in the reclined position.

Although the seat component 44 is shown in FIGS. 8 and 9 as having respectively a substantially rectangular and a substantially disc-shaped cross-sectional configuration, it should be understood that the seat component 44 could have any other suitable configuration without departing from the scope of the present invention.

Also, as illustrated more specifically in FIGS. 4 and 8, the seat component 44 is typically provided with a cushioning component 56 mounted thereon for cushioning the contact between the seat component 44 and the crotch 30 of the intended user 12. The cushioning component 56 is typically made out of closed cell foam or any other suitable polymeric or elastomeric material.

The device 10 is preferably provided with an oar coupling means for operatively coupling an oar thereto. Typically, the oar coupling means is coupled to the seat component 44. The oar coupling means may however be otherwise positioned without departing from the scope of the present invention.

As illustrated more specifically in FIG. 8, the oar coupling means typically includes a coupling component 58 extending from the seat component 44. Preferably, the oar coupling component 58 allows releasable coupling of at least one and preferably a pair of oars 60 thereto.

The oars 60 may take any suitable form. For example, the oars 60 may include a generally flat paddle section 62 extending from a substantially elongated handle section 64. The proximal end of the handle section 64 may be provided with a hook 66 or other suitable attachment means.

As illustrated more specifically in FIG. 8, in one possible embodiment of the invention, the oar coupling component 58 has a substantially T-shaped configuration defining a first attachment segment 68 and a substantially perpendicular second attachment segment 70. The first attachment segment 68 is provided with a pair of oar attachment apertures 72 extending therethrough for receiving the hooks 66. The second attachment segment 70 is provided with a pair of forked tines 74 configured and sized for attachment to the seating segment 54 on each side of the latter.

Typically, attachment pins 76 extend through corresponding attachment apertures 78, 80 formed respectively in the tines 74 and the second seating segment 54 for releasably attaching the coupling component 58 to the seat component 44.

As illustrated more specifically in FIGS. 10 and 11, the seating and/or coupling components 44, 58 are typically configured, sized and positioned relative to each other so as to allow the arms 26 of the intended user 12 to reach the handle segments 64 of the oars 60 when the flotation device is in the reclining position shown in FIG. 10 and preferably also when the flotation device 10 is in the seating position shown in FIG. 11.

Figure 3:
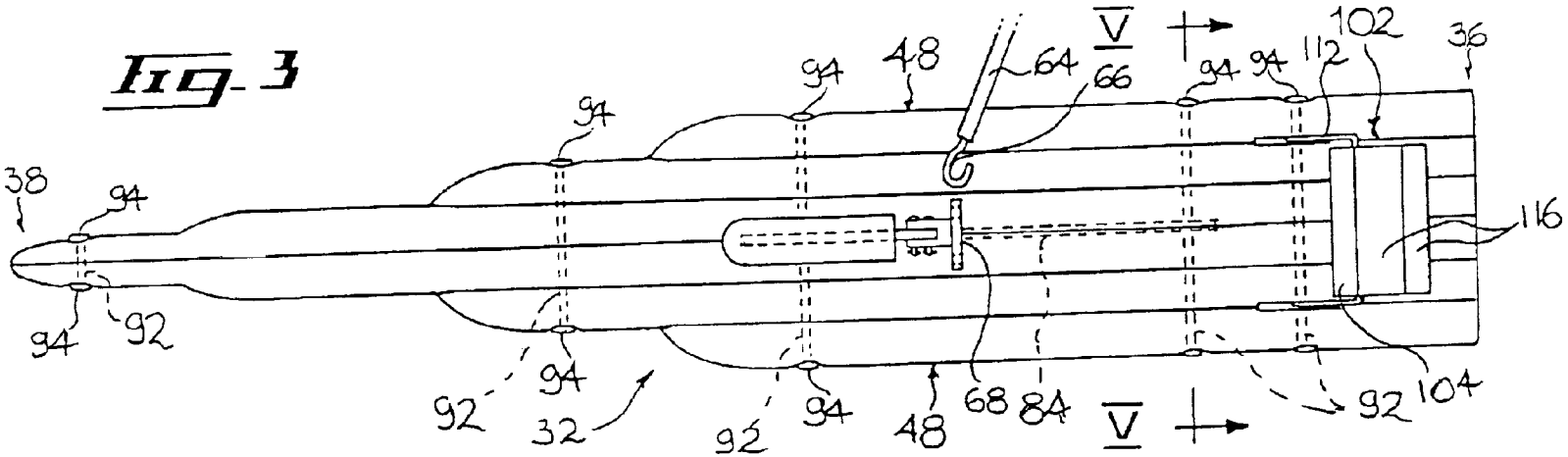
FIG. 3: in a top view with sections taken out illustrates the flotation device shown in FIG. 1.

As illustrated more specifically in FIGS. 3 and 4, the body 32 is typically further provided with a solidifying means for forming a solidified portion 82 of the body 32. The solidified portion 82 typically extends from a position located substantially adjacent to the seat component 44 towards the body first longitudinal end 36.

The solidifying means typically includes a solidifying component 84 made out of a substantially rigid material. Typically, the solidified component 84 includes a solidifying plate made out of a suitable polymeric resin, a metallic alloy or any other suitable material. Typically, the solidifying component 84 is configured and sized so as to be at least partially embeddable in the body 32.

In the embodiment shown throughout the Figures, the solidifying component 84 has a substantially elongated configuration and extends integrally from the first seating segment 52 of the seat component 44. It should however be understood that the solidifying component 84 could assume other configurations without departing from the scope of the present invention.

As illustrated more specifically in FIG. 4, the device 10 is typically further provided with a keel 86 extending substantially outwardly from the body second main surface 42. In FIG. 4, the keel 86 is shown as having a distal edge 88 extending inwardly towards the body second longitudinal end 38. It should however be understood that the keel 86 could have other configurations without departing from the scope of the present invention.

Typically, the keel 86 is formed by a protruding segment of the solidifying component 84. It should however be understood that the keel 86 could be a distinct component or be otherwise manufactured without departing from the scope of the present invention.

As shown more specifically in FIGS. 1 through 3, the body 32 is typically made out of at least two generally elongated body sections 90. The body 32 also includes an attachment means for attaching the body sections 90 together in a lateral or side-by-side relationship relative to each other.

In the embodiment shown in FIGS. 1 and, 3 through 5, the body 32 includes substantially cylindrical body sections 90 of different lengths assembled together in a side-by-side relationship relative to each other. The body sections 90 may for example be conventional tubes or "noodles" of closed cell foam or any other suitable body section. In the embodiment shown in FIG. 2, the body 32 is made out of two symmetrically disposed and profiled body sections 90'. It should however be understood that any suitable number of body sections 90 having any suitable configuration and being made out of any suitable material may be used without departing from the scope of the present invention.

As illustrated more specifically in FIGS. 3 through 6, the section attachment means includes at least one and preferably a set of attachment rods 92 extending substantially transversally across the body sections 90. Each attachment rod 92 is preferably provided with a rod releasable locking means for releasably locking the corresponding rod 92 in a predetermined attachment configuration wherein the attachment rod 92 releasably maintains the body sections 90 in a side-by-side relationship relative to each other.

For example, the rod releasable locking means may include a pair of abutment heads 94. Typically one of the abutment heads 94 is fixably attached to a first longitudinal end of a corresponding attachment rod 92 while the opposed abutment head 94 is releasably secured to the other longitudinal end of the attachment rod 92 using suitable means such as a threaded shaft 96 and a corresponding threaded sleeve 98.

The rod releasable locking means allows for customization of the type and number of body sections 90 as well as possible replacement thereof through a set of quick and ergonomical steps.

Preferably, the solidifying component 84 is provided with at least one rod receiving aperture 100 extending therethrough for substantially fittingly receiving a corresponding attachment rod 92. The solidifying component 94 hence typically not only acts as a body solidifying means but also as a keel and further possibly as an attachment means for maintaining the attachment rods 92 in a predetermined spaced and parallel relationship relative to each other.

The flotation device 10 typically further includes a headrest component 102. The headrest component 102 is attached to the body 32 so as to contact the body first main surface 40 substantially adjacent to the body first longitudinal end 36. As illustrated more specifically in FIGS. 4 and 7, the headrest component 102 is attached to the body 32 so as to be positionable in at least two headrest configurations or positions along the body first main surface 40.

As illustrated more specifically in FIGS. 5 and 7, the headrest component 102 includes at least one substantially cylindrical headrest main section 104. The headrest component 102 also includes a substantially U-shaped attachment bracket 106. The attachment bracket 106, in turn, includes a retaining segment 108 extending through a retaining channel 110 formed in the headrest main section 104. The attachment bracket 106 also includes a pair of substantially perpendicular attachment segments 112 extending from the retaining segment 108 and pivotally attached to the body 32.

As illustrated more specifically in FIG. 7, the proximal end of each attachment segment 112 typically has a substantially hook-shaped configuration for allowing pivotal attachment thereof to a corresponding attachment rod 92. The pivotal attachment between the attachment segments 112 and the attachment rod 92 allows for pivotal movements as indicated schematically by arrow 114.

Typically, the headrest component 102 further includes a pair of auxiliary headrest sections 116 together forming with the main headrest section 104 in a substantially triangular cross sectional configuration such as shown in FIGS. 4 and 7. Typically, the main and auxiliary headrest sections 104, 116 are pivotable about the retaining segment 108 so as to allow further modification of the position of the headrest component 102 relative to the body 32 as indicated by arrow 118 in FIG. 4. The main and auxiliary headrest sections 104, 116 again may be made out of closed cell foam or other suitable material.

I claim:

1. A flotation device for supporting a person in a volume of water, said volume of water defining a surface of water, said person having a trunk defining a trunk front surface and a trunk rear surface, said person also having a head, a pair of arms and a pair of legs all extending from said trunk, said legs merging into a crotch; said flotation device comprising:

a substantially buoyant body, said body having a substantially elongated configuration, said body defining a body longitudinal axis, a body first longitudinal end and a substantially opposed body second longitudinal end, said body also defining a body first main surface and an opposed body second main surface;

a seat component extending substantially outwardly from said body first main surface intermediate said body first and second longitudinal ends;

said body and said seat component being configured, sized and positioned relative to each other so as to allow said device to buoyantly support said person in said volume of water in both a reclining and a sitting position wherein when in said reclining position, said body is in a substantially flat configuration and, wherein when in said sitting position, said body is substantially bent about a bending location positioned substantially adjacent to said seat component so as to allow at least part of said body first surface located between said body first longitudinal end and said seat component to abuttingly support at least part of said trunk rear surface and so as to also allow said seat component to extend between said legs adjacent said crotch of said person for abuttingly supporting said person.

2. A flotation device as recited in claim 1 wherein said body is made out of a substantially resiliently bendable material at least adjacent to said bending location.

3. A flotation device as recited in claim 1 wherein said bending location is located intermediate said seat component and said body second longitudinal end.

4. A flotation device as recited in claim 1 wherein said body has a substantially "J"-shaped configuration when used in said sitting position for supporting said person in said volume of water.

5. A flotation device as recited in claim 1 wherein said body defines a pair of opposed body lateral edges, said body lateral edges tapering towards each other from a tapering location towards said body second longitudinal end.

6. A flotation device as recited in claim 5 wherein said tapering location is located intermediate said body second longitudinal end and said seat component substantially adjacent to the latter.

7. A flotation device as recited in claim 5 wherein said body lateral edges are configured and sized to allow at least a portion of said legs of said person to be located outside said body lateral edges when said flotation device is in said sitting position.

8. A flotation device as recited in claim 5 wherein said body lateral edges are configured and sized to provide said body with a substantially hydrodynamical profile when said flotation device is in said reclining position.

9. A flotation device as recited in claim 1 wherein said seat component has a substantially "J"-shaped configuration including a first seating segment having a substantially arcuate configuration extending from said body first main surface and a second seating segment extending from said first seating segment towards said body first longitudinal end in a substantially parallel and spaced relationship relative to said body first main surface.

10. A flotation device as recited in claim 1 wherein said seat component is provided with an oar coupling means for operatively coupling an oar thereto.

11. A flotation device as recited in claim 10 wherein said seat component is configured, sized and positioned to allow said arms of said person to reach said oar when said flotation device is in said reclining position.

12. A floatation device as recited in claim 10 wherein said oar coupling moans includes a coupling component extending from said seat component, said oar coupling component allowing releasable coupling of said oar thereto.

13. A flotation device as recited in claim 12 wherein said oar coupling component has a substantially "T"-shaped configuration defining a first attachment segment and a substantially perpendicular second attachment segment, said first attachment segment being provided with a pair of oar attachment apertures extending therethrough and said second attachment segment being provided with a pair of forked tines configured and sized for attachment to said seat component on each side of the latter.

14. A flotation device as recited in claim 1 wherein said body is further provided with a solidifying moans for forming a solidified portion of said body, said solidified portion extending from a position located substantially adjacent said seat component towards said body first longitudinal end.

15. A flotation device as recited in claim 14 wherein said solidifying means includes a solidifying component made out of a substantially rigid material, said solidifying component being at least partially embedded in said body.

16. A flotation device as recited in claim 15 wherein said solidifying component has a substantially elongated configuration and extends Integrally from said seat component.

17. A flotation device as recited in claim 1 further comprising a keel extending substantially outwardly from said body second main surface.

18. A flotation device as recited in claim 1 wherein said body is further provided with a solidifying means for forming a solidified portion of said body, said solidified portion extending from a position located substantially adjacent said seat component towards said body first longitudinal end; said solidifying means including a solidifying component made out of a substantially rigid material, said solidifying component being at least partially embedded in said body, said solidifying component also extending substantially outwardly from said body second main surface to act as a keel when said body is in said reclined position.

19. A flotation device as recited in claim 1 wherein said body is made out of at least two generally elongated body sections, said body also including a section attachment means for attaching said body sections together in a lateral relationship relative to each other.

20. A flotation device as recited in claim 19 wherein at least one of said body sections is made out of closed cell foam material.

21. A flotation device as recited in claim 19 wherein said section attachment means includes an attachment rod extending substantially transversally across said body sections.

22. A flotation device as recited in claim 21 wherein said attachment rod is provided with a releasable rod locking means for releasably locking said rod in a predetermined attachment configuration wherein said attachment rod releasably maintains said body sections in a side-by side relationship relative to each other.

23. A flotation device as recited in claim 21 wherein said body is further provided with a solidifying means for forming a solidified portion of said body, said solidified portion extendIng from a position located substantially adjacent said seat component towards said body first longitudinal end; said solidifying means including a solidifying component made out of a substantially rigid material, said solidifying component being at least partially embedded in said body, said solidifying component being provided with a rod receiving g aperture extending therethrough, said attachment rod extending substantially fittingly through said rod receiving aperture.

24. A flotation device as recited in claim 1 further comprising a headrest component, said headrest component being attached to said body so as to contact said body first main surface substantially adjacent to said body first longitudinal end.

25. A flotation device as recited in claim 24 wherein said headrest component is attached to said body so as to be positionable in at least two headrest configurations along said body first main surface.

26. A flotation device as recited in claim 24 wherein said headrest component includes at least one substantially cylindrical headrest section, said headrest component also including a substantially "U"-shaped attachment bracket, said attachment bracket including a retaining segment extending through said headrest section and a pair of substantially perpendicular attachment segment extending from said retaining segment, said attachment segment being pivotaly attached to said body.

27. A flotation device as recited in claim 26 wherein said headrest component includes three headrest sections together forming a substantially triangular cross-sectional configuration, said headrest sections being pivotable about said retaining segment to modify the position of said headrest component on said body.

28. A flotation device for supporting a person in a volume of water, said volume of water defining a surface of water, said person having a trunk defining a trunk front surface and a trunk rear surface, said person also having a head, a pair of arms and a pair of legs all extending from said trunk, said legs merging into a crotch; said flotation device comprising:

a substantially buoyant body, said body having a substantially elongated configuration, said body defining a body longitudinal axis, a body first longitudinal end and a substantially opposed body second longitudinal end, said body also defining a body first main surface and an opposed body second main surface:

said body allowing said device to buoyantly support said person in said volume of water in both a reclining and a sitting position wherein when in said reclining position, said body is in a substantially flat configuration and, wherein when in said sitting position, said body is substantially bent about a bending location intermediate said body first and second longitudinal ends so as to allow at least part of said body first surface located between said body first longitudinal end and said bending location to abuttingly support at least part of said trunk rear surface and so as to also allow said body adjacent said bending location to extend between said legs adjacent said crotch of said person for abuttingly supporting said person;

said body being further provided with a solidifying means for forming a solidified portion of said body, said solidified portion extending from a position located substantially adjacent said bending location towards said body first longitudinal end; said solidifying means including a solidifying component made out of a substantially rigid material, said solidifying component being at least partially embedded in said body, said solidifying component also extending substantially outwardly from said body second main surface to act as a keel when said body is in said reclined position.

29. A flotation device for supporting a person in a volume of water, said volume of water defining a surface of water, said person having a trunk defining a trunk front surface and a trunk rear surface, said person also having a head, a pair of arms and a pair of legs all extending from said trunk, said legs merging into a crotch; said flotation device comprising:

a substantially buoyant body, said body having a substantially elongated configuration, said body defining a body longitudinal axis, a body first longitudinal end and a substantially opposed body second longitudinal end, said body also defining a body first main surface and an opposed body second main surface;

said body allowing said device to buoyantly support said person In said volume of water In both a reclining and a sitting position wherein when in said reclining position, said body is in a substantially flat configuration and, wherein when in said sitting position, said body is substantially bent about a bending location intermediate said body first and second longitudinal ends so as to allow at least part of said body first surface located between said body first longitudinal end and said bending location to abuttingly support at least part of said trunk rear surface and so as to also allow body adjacent said bending location to extend between said legs adjacent said crotch of said person for abuttingly supporting said person;

said body being further provided with a solidifying means for forming a solidified portion of said body, said solidified portion extending from a position located substantially adjacent Bald bending location towards said body first longitudinal end; said solidifying means including a solidifying component made out of a substantially rigid material, said solidifying component being at least partially embedded in said body, said body being made out of at least two generally elongated body sections, said body also including a section attachment means for attaching said body sections together in a lateral relationship relative to each other; said section attachment means including an attachment rod extending substantially transversally across said body sections;

said solidifying component being provided with a rod receiving aperture extending therethrough, said attachment rod extending substantially fittingly through said rod receiving aperture.

30. A flotation device as recited in claim 29 wherein said solidifying component also extends substantially outwardly from said body second main surface to act as a keel when said body is in said reclined position.

* * * * *